United States Patent [19]

Barnes et al.

[11] Patent Number: 4,903,714

[45] Date of Patent: Feb. 27, 1990

[54] SMOKING ARTICLE WITH IMPROVED MOUTHEND PIECE

[75] Inventors: Russell D. Barnes, Belews Creek; Gary R. Shelar, Greensboro, both of N.C.; Edward P. Bullwinkel, Roswell, Ga.; William F. Cartwright, Roswell, Ga.; Leon E. Chambers, Jr., Roswell, Ga.; Donald F. Durocher, Roswell, Ga.; Robert G. Geer, Woodstock, Ga.; Loyd G. Kasbo; Fred R. Radwanski, both of Norcross, Ga.

[73] Assignee: R. J. Reynolds Tobacco Company, Winston-Salem, N.C.

[21] Appl. No.: 89,692

[22] Filed: Aug. 25, 1987

[51] Int. Cl.[4] ..... A24D 1/00; A24D 3/04

[52] U.S. Cl. ..... 131/335; 131/194

[58] Field of Search ..... 131/194, 195, 196, 198.1, 131/336, 335, 337, 349, 365, 359

[56] References Cited

U.S. PATENT DOCUMENTS

| | | |
|---|---|---|
| 2,001,709 | 5/1935 | Davidson . |
| 2,039,298 | 5/1936 | Davidson . |
| 2,164,702 | 7/1939 | Davidson . |
| 2,202,839 | 6/1940 | Davidson . |
| 2,900,989 | 8/1959 | Davidson . |
| 2,907,686 | 10/1959 | Siegel . |
| 3,110,642 | 11/1963 | Harrington, Jr. et al. . |
| 3,226,795 | 1/1966 | Swerdloff et al. . |
| 3,258,015 | 6/1966 | Ellis et al. . |
| 3,329,544 | 7/1967 | Smith . |
| 3,356,094 | 12/1967 | Ellis et al. . |
| 3,393,685 | 7/1968 | Mumpower et al. . |
| 3,396,733 | 8/1968 | Allseits et al. . |
| 3,407,822 | 10/1968 | Touey et al. . |
| 3,461,882 | 8/1969 | Epstein . |
| 3,509,009 | 4/1970 | Hartmann . |
| 3,516,417 | 6/1970 | Moses . |
| 3,538,920 | 11/1970 | Davis . |
| 3,595,245 | 7/1971 | Buntin . |
| 3,608,564 | 9/1971 | Takahashi . |
| 3,749,685 | 7/1973 | Johnson . |
| 3,849,241 | 11/1974 | Buntin et al. . |
| 3,856,025 | 12/1974 | Sato et al. . |
| 3,861,404 | 1/1975 | Changani . |
| 3,880,173 | 4/1975 | Hill . |
| 3,882,877 | 5/1975 | Brackmann et al. . |
| 3,887,730 | 6/1975 | Rainer et al. . |
| 3,930,077 | 12/1975 | Levers et al. . |
| 3,939,849 | 12/1976 | Baxter et al. . |
| 3,943,941 | 3/1976 | Boyd et al. . |
| 3,978,185 | 8/1976 | Buntin et al. . |
| 4,044,777 | 8/1977 | Boyd et al. . |
| 4,054,550 | 10/1977 | Parker et al. . |
| 4,059,121 | 11/1977 | Brackmann et al. . |
| 4,079,742 | 3/1978 | Rainer et al. . |
| 4,182,350 | 1/1980 | Steinau . |
| 4,232,130 | 11/1980 | Baxter et al. . |
| 4,279,848 | 7/1981 | Baxter et al. . |
| 4,284,089 | 8/1981 | Ray . |
| 4,286,604 | 9/1981 | Ehretsmann et al. . |
| 4,291,711 | 9/1981 | Berger . |
| 4,326,544 | 4/1982 | Hardwick et al. . |
| 4,340,072 | 7/1982 | Bolt et al. . |
| 4,355,995 | 10/1982 | Berger . |
| 4,379,465 | 4/1983 | Coq . |
| 4,391,285 | 7/1983 | Burnett et al. . |
| 4,474,191 | 10/1984 | Steiner . |
| 4,546,040 | 10/1983 | Knotek et al. . |

FOREIGN PATENT DOCUMENTS

| | | |
|---|---|---|
| 174645 | of 0000 | European Pat. Off. . |
| 177355 | of 0000 | European Pat. Off. . |
| 212234 | of 0000 | European Pat. Off. . |
| 23237 | of 0000 | Iran . |

*Primary Examiner*—V. Millin

*Attorney, Agent, or Firm*—Grover M. Myers; David G. Conlin

[57] ABSTRACT

The present invention relates to smoking articles having an improved mouthend piece. More specifically, it relates to cigarette-type smoking articles comprising a fuel element, a physically separate aerosol generating means including an aerosol forming material, and means for delivering the aerosol produced by the aerosol generating means to the user in the form of a mouthend piece, the mouthend piece including a nonwoven web segment formed from meltblown thermoplastic fibers or filaments, and a spacer member located between the aerosol generating means and the non woven web segment.

51 Claims, 4 Drawing Sheets

FUEL END PIECE | 30mm CELLULOSE ACETATE TUBE | 10mm CELLULOSE ACETATE TOW FILTER

FUEL END PIECE | 10mm TOBACCO | 30 mm POLYPROPYLENE

FUEL END PIECE | 10 mm CELLULOSE ACETATE TUBE | 30 mm POLYPROPYLENE

FUEL END PIECE | 20mm CELLULOSE ACETATE TUBE | 20 mm POLYPROPYLENE

FUEL END PIECE | 10mm TOBACCO | 10 mm CELLULOSE ACETATE TUBE | 20 mm POLYPROPYLENE

SMOKING ARTICLE WITH IMPROVED MOUTHEND PIECE

BACKGROUND OF THE INVENTION

The present invention relates to a smoking article having a fuel element, a physically separate aerosol generating means, and an improved mouthend piece which comprises a segment of non-woven thermoplastic fibers or filaments for delivering the aerosol produced to the user, and which, in preferred embodiments, includes a spacer member which separates the segment of thermoplastic material from the aerosol generating means. More specifically, the present invention is directed to a non-woven web of meltblown thermoplastic fibers employed as least as a portion of the mouthend piece of such articles. Smoking articles employing the improved mouthend piece help reduce the temperature of the aerosol perceived by the user without interfering with delivery of the aerosol. Such articles also produce an aerosol resembling tobacco smoke, but which contains no more than a minimal amount of incomplete combustion or pyrolysis products.

Cigarette-like smoking articles have been proposed for many years. See for example, U.S. Pat. No. 4,079,742 to Rainer et al; U.S. Pat. No. 4,84,089 to Ray; U.S. Pat. No. 2,907,686 to Siegel; U.S. Pat. Nos. 3,258,015 and 3,356,094 to Ellis et al.; U.S. Pat. No. 3,516,417 to Moses; U.S. Pat. Nos. 3,943,941 and 4,044,777 to Boyd et al.; U.S. Pat. No. 4,286,604 to Ehretsmann et al.; U.S. Pat. No. 4,326,544 to Hardwick et al.; U.S. Pat. No. 4,340,072 to Bolt et al.; U.S. Pat. No. 4,391,285 to Burnett; U.S. Pat. No. 4,474,191 to Steiner; and European Patent Appln. No. 117,355 (Hearn).

As far as the present inventors are aware, none of the foregoing smoking articles has ever realized any commercial success and none have ever been widely marketed. The absence of such smoking articles from the marketplace is believed to be due to a variety of reasons, including insufficient aerosol generation, both initially and over the life of the product, poor taste, off-taste due to thermal degradation of the smoke former and/or flavor agents, the presence of substantial pyrolysis products and sidestream smoke, and unsightly appearance.

Thus, despite decades of interest and effort, there is still no smoking article on the market which provides the benefits and advantages associated with conventional cigarette smoking, without delivering considerable quantities of incomplete combustion and pyrolysis products.

In late 1985, a series of foreign patents was granted or registered disclosing novel smoking articles capable of providing the benefits and advantages associated with conventional cigarette smoking, without delivering appreciable quantities of incomplete combustion or pyrolysis products. The earliest of these patents was Liberian Patent No. 13985/3890, issued Sept. 13, 1985. This patent corresponds to a later published European Patent Application, Publication No. 174,645, published 19 March 1986.

SUMMARY OF THE INVENTION

The present invention relates to a smoking article having a fuel element, a physically separate aerosol generating means, and an improved mouthend piece for delivering the aerosol produced to the user. The mouthend piece comprises a non-woven web of thermoplastic fibers or filaments in the form of a low efficiency, heat dispersing mass of material in the form of a filter plug. The mouthend piece may also include a spacer member located between the thermoplastic mass and the aerosol generating means. It has been found that unlike conventional mouthend pieces, such as cellulose acetate tow, use of the improved mouthend piece of the present invention reduces the aerosol temperature perceived by the user without interfering with delivery of desired amounts of the aerosol.

Preferably, the smoking articles which employ the improved mouthend piece are of the cigarette type, which utilize a short, i.e., less than about 30 mm long, preferably carbonaceous, fuel element. Preferably, the aerosol generating means also is in a conductive heat exchange relationship with the fuel element. The mouthend piece of the present invention preferably comprises a cylindrical segment of a web of non-woven meltblown thermoplastic fibers which is gathered or folded into the shape of a conventional filter plug approximately 10 to 40 mm, preferably 15 to 35 mm, in length, together with a folded or gathered tobacco paper spacer member approximately 5 to 30 mm, preferably 5 to 15 mm, in length located between the non-woven web segment and the aerosol generating means.

Conventional cigarette mouthend pieces normally consist of moderate to high efficiency filter materials, such as cellulose acetate tow. Such materials generally have fibers which are primarily oriented in the smoking direction which may result in air being channeled through a relatively small fraction of the filter. One notices, for example upon smoking filtered cigarettes, that only a portion of the filter appears discolored, evidencing the channeling of smoke in that portion of the filter. This channeling effect is often perceived by the user as a "hot spot" on the lips or tongue.

It has been found that the improved mouthend piece in accordance with the present invention, and in particular the non-woven thermoplastic web component, acts as a heat sink and helps to reduce perceived hot spots by distributing the aerosol generated during smoking over a large surface area, preferably over substantially the entire surface area of the mouthend piece component(s). It is believed that distribution of the aerosol over a large surface area contributes to the perceived reduction in temperature by increasing the residence time of the aerosol in the mouthend piece, and in particular in the segment of non-woven thermoplastic material. Moreover, unlike conventional mouthend pieces which are generally used to filter out substantial amounts of various undesirable components of tobacco smoke, smoking articles employing the non-woven thermoplastic material as the mouthend piece in accordance with the present invention provide such perceived temperature reductions without substantial reduction in the delivery of the aerosol components, e.g. glycerin, flavor components, and the like. In other words, the filter efficiency of such materials is substantially lower than that of conventional cigarette filter material such as cellulose acetate tow, which is important in maintaining desired delivery of the aerosol generated by the smoking articles of the present invention and permitting the use of longer sections of material to provide increased residence and cooling of the aerosol.

The preferred spacer member, like the segment of non-woven thermoplastic material, is preferably a low filter efficiency material and also acts as a heat sink which not only helps to reduce the temperature of aerosol perceived by the user but also helps to prevent undesirable degradation or melting of the non-woven thermoplastic material.

Preferred smoking articles employing the improved mouthend piece in accordance with the present invention are capable of delivering at least 0.6 mg of aerosol, measured as wet total particulate matter (WTPM), in the first 3 puffs, when smoked under FTC smoking conditions, which consist of 35 ml puffs of two seconds duration, separated by 58 seconds of smolder. More preferably, embodiments of the invention are capable of delivering 1.5 mg or more of aerosol in the first 3 puffs. Most preferably, embodiments of the invention are capable of delivering 3 mg or more of aerosol in the first 3 puffs when smoked under FTC smoking conditions. Moreover, preferred embodiments of the invention deliver an average of at least about 0.8 mg of WTPM per puff for at least about 6 puffs, preferably at least about 10 puffs, under FTC smoking conditions.

In addition to the aforementioned benefits, preferred smoking articles of the present invention are capable of providing an aerosol which is chemically simple, consisting essentially of air, oxides of carbon, water, the aerosol former, any desired flavors or other desired volatile materials, and trace amounts of other materials. The aerosol preferably also has no significant mutagenic activity as measured by the Ames Test. In addition preferred articles may be made virtually ashless, so that the user does not have to remove any ash during use.

As used herein, and only for the purposes of this application, "aerosol" is defined to include vapors, gases, particles, and the like, both visible and invisible, and especially those components perceived by the user to be "smoke-like", generated by action of the heat from the burning fuel element upon substances contained within the aerosol generating means, or elsewhere in the article. As so defined, the term "aerosol" also includes volatile flavoring agents and/or pharmacologically or physiologically active agents, irrespective of whether they produce a visible aerosol.

As used herein, the phrase "conductive heat exchange relationship" is defined as a physical arrangement of the aerosol generating means and the fuel element whereby heat is transferred by conduction from the burning fuel element to the aerosol generating means substantially throughout the burning period of the fuel element. Conductive heat exchange relationships can be achieved by placing the aerosol generating means in contact with the fuel element and thus in close proximity to the burning portion of the fuel element and/or by utilizing a conductive member to transfer heat from the burning fuel to the aerosol generating means. Preferably both methods of providing conductive heat transfer are used.

As used herein, the term "carbonaceous" means primarily comprising carbon.

As used herein, the term "insulating member" applies to all materials which act primarily as insulators. Preferably, these materials do not burn during use, but they may include slow burning carbons and like materials, as well as materials which fuse during use, such as low temperature grades of glass fibers. Suitable insulators have a thermal conductivity in g-cal(sec) (cm2) (°C/cm), of less than about 0.05, preferably less than about 0.02, most preferably less than about 0.005. See, *Hackh's Chemical Dictionary* 672 (4th ed., 1969) and Lange's *Handbook of Chemistry* 10, 272–274 (11th ed., 1973).

Smoking articles which employ the improved filter material in accordance with the present invention are described in greater detail in the accompanying drawings and the detailed description of the invention which follow.

Filter 5A illustrates a double cone system used to gather or fold material into the shape of a filter plug.

Figure 6:
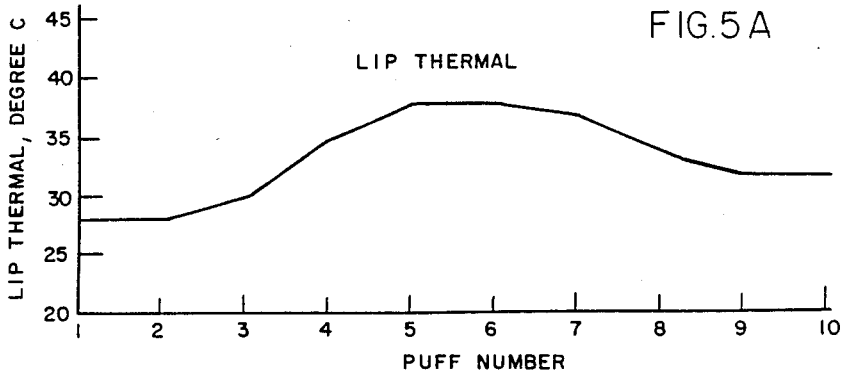

FIG. 6 illustrates the lip thermal temperature of a mouthend piece constructed in accordance with the present invention.

DETAILED DESCRIPTION OF THE PREFERRED EMBODIMENTS

In accordance with the present invention, there is provided an improved mouthend piece for use in smoking articles. The mouthend piece is particularly suited for smoking articles having a combustible fuel element and a physically separate aerosol generating means such as those described in the above-referenced EPO Publication No. 174,645 as well as in EPO Publication No. 212,234.

In general, the improved mouthend piece comprises a segment formed from a non-woven web of thermoplastic fibers or filaments and may also include a spacer member located between the segment of thermoplastic fibers and the aerosol generating means.

The preferred means for making such thermoplastic webs is by meltblowing such as is described in U.S. Pat. No. 3,849,241 to Buntin et al. issued Nov. 19, 1974, the disclosure of which is incorporated herein by reference.

Figure 4:
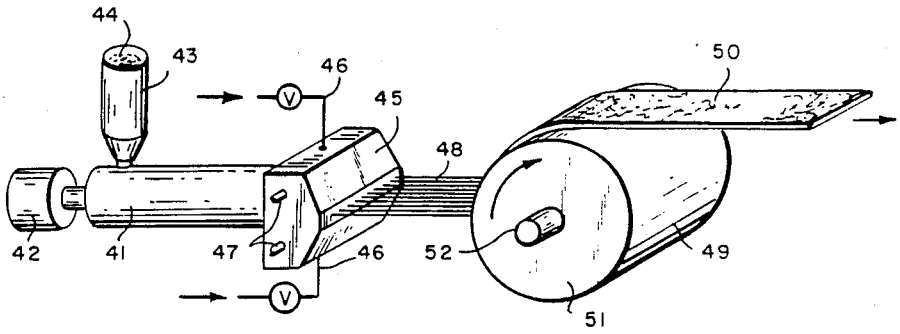
FIG. 4 illustrates one preferred method for forming the non-woven meltblown thermoplastic web useful in forming the mouthend piece of the present invention.

FIG. 4 illustrates conventional meltblowing. Extruder 41 driven by motor 42 receives thermoplastic polymer pellets 44 from hopper 43. The extruder is heated as necessary to bring the polymer to the desired viscosity as it enters die 45. As the extruded polymer exits die 45, normally vertically downward, it is contacted from opposing sides by hot air from conduits 46. As needed, die 45 may be heated electrically or by other means using conduits 47. Fibers 48 are carried by the air stream onto collecting surface 49 forming mat 50. The collecting surface 49 may comprise rotating drum 51 driven about axis 52 as shown or may be a belt, screen or other collecting device as will be apparent to those skilled in this art.

The thermoplastic web may be formed into a cylindrical or other appropriate shape by conventional filter plug making techniques such as ordinary plugmakers used to make cellulose acetate tow.

Figure 5:
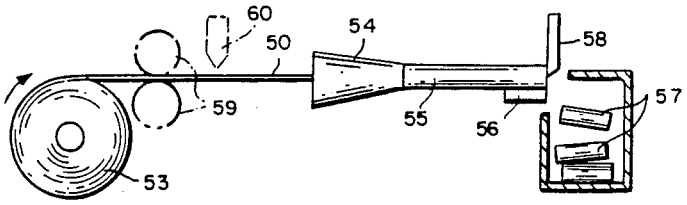
FIG. 5 schematically illustrates a method for forming the meltblown thermoplastic web into a cylindrical segment in the shape of a filter plug.

FIG. 5 illustrates one means for forming the webs into a filter plug. As shown schematically in FIG. 5, a roll 53 of thermoplastic fiber web 50 is unwound and drawn into a pre-forming tapered cone 54 that "gathers" or "folds" the flat web 50 into a cylindrical shape suitable for passage into the filter plugmaker. This formed cylinder 55 receives a wrapping of paper web 56 (so called plug wrap) and the combination is cut into desired lengths 57 using blade 58. Prior to entering the garniture, a continuous bead of adhesive is applied to one edge of the plugwrap via an applicator. As these components pass through the garniture, the formed web is further compressed into a cylindrical cross-sectional rod while at the same time being enveloped by the plugwrap 56. As the adhesive bead contacts the overlapped section of wrapped rod, it is sealed by means of a sealing bar. This endless filter rod is then cut into lengths 57 by means of cuter 58.

While not essential for making acceptable filter plugs, the thermoplastic webs lend themselves to pre-treatment prior to being formed into a rod. Two such treatments, illustrated in FIG. 5, may include a pair of grooved rolls 59 used for crimping and a liquid applicator 60 used for surface treating the material with, for example, glycerin or other humectants.

Figure 5A:
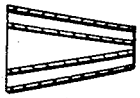

Alternatively, it is preferred to use the double cone system illustrated in FIG. 5A in lieu of the single cone 54. This system comprises a cone within a cone as the preforming apparatus. The thermoplastic web material is fed into the annular space between the cones in a substantially tension-free state, such that at the entry point, the web material wraps around the radial portion of the inner cone. The cones may be moved in relation to each other in order to achieve the desired uniformity and firmness of the filter plug.

While most thermoplastic polymers may be used in preparing the web material used to make the segment of thermoplastic fibers, the preferred thermoplastic polymers are polyolefins such as isotactic polypropylene, and polyesters such as poly (butylene terephthalate) Due to the nature of the meltblown thermoforming process, various additives (e.g., calcium bonate) be easily incorporated internally in the polymer melt or blown onto the molten polymer surface as it is extruded in order to change the structure of the meltblown web and thus its performance in a filter element. Also, meltblown webs, after formation, are easily subject to known post treatments with auxiliary agents in dry or liquid form to provide certain organoleptic and/or medicinal attributes.

The basic weight of such webs may vary depending on a number of factors including the process used to form the web material as well as the particular thermoplastic polymer used. For preferred meltblown polypropylene materials, the basis weight is preferably in the range of from about 0.5 oz/yd$^2$ to 1.0 oz/yd$^2$.

The grab tensile strengths of such webs may also vary but generally are in the range of from about 0.1 pound to about 3.0 pounds in the cross machine direction (CD) and at least about 0.1 pound in the machine direction (MD). Preferred ranges are from about 0.7 to about 2.4 pounds in the machine direction and from about 0.5 to about 2.3 pounds in the cross machine direction. Preferred webs will also have a grab tensile strength providing a ratio of MD to CD in the range of about 1:1 to 4:1 and preferably in the range of 1:1 to 2:1. The grab tensile strength of such materials is determined generally in accordance with the Method 5100-Federal Test Methods Standard No. 191A using an Instron Model 1122 Testing Instrument available from Instron Corporation. These strengths generally depend on a number of factors including the web's machine direction to cross machine direction fiber orientation, degree of fiber to fiber fusion and fiber width distribution.

The Frazier porosity of such webs may also range generally from about 100 cu.ft./sq.ft./min. to about 1000 cu ft./sq.ft./min. and, preferably in the range of from about 150 cu.ft./sq.ft./min. to about 1000 cu.ft./sq.ft./min. (for a 5-ply sample). The Frazier porosity tests on such materials are determined using a Frazier air permeability tester available from Frazier Precision Instrument Company. These porosity measurements reflect the air permeability of the web. The procedure conforms to Method 5450, Federal Test Methods Standard No. 191A except that the specimen size used is 8 inches by 8 inches, and a 5-ply sample is measured with 20 mm air nozzle. Frazier units are expressed in cubic feet of air per square foot of specimen per minute.

The percent open area of such webs generally will be from about 10 percent to 60 percent with a preferred range of from about 14 percent to 52 percent. The percent open area is a measure of the web's openness and may be measured using a Quantimet Model 970 image analyzer available from Cambridge Instruments. This property is significant in determining the filtration characteristics of cylinders made from webs in accordance with the present invention.

A particularly preferred web material useful for forming the improved filter plug in accordance with the present invention is an experimental meltblown polypropylene material obtained from Kimberly-Clark Corporation designated PP-100-F. This particular material has a Frazier permeability of about 600, Grab Tensile Strength of about 1.3 pounds (MD) and 0.7 pounds (CD), and a basis weight of about 0.75 oz/yd$^2$. This material also has incorporated therein glycerin in an amount of about 2% by weight to facilitate formation of the material into a cylinder. The amount of glycerin, or other humectant, used may vary between about 0.5 and 8%, preferably between about and 4%, and most preferably between about 1.5 and 2.5%. Such materials are described in greater detail in United States Application Ser. No. 003,980 filed on Jan. 16, 1987, the disclosure of which is hereby incorporated by reference.

From a performance and/or aesthetic standpoint the filter firmness of the thermoplastic segments employed in accordance with the present invention may vary broadly without substantially interfering with delivery of aerosol to the user. However, it is desirable to have a segment which feels and has the firmness of a cigarette which employs conventional cellulose acetate filters. While there are a number of ways of evaluating the firmness of a filter material, firmness results for segments of thermoplastic fibers prepared from Kimberly-Clark Corporation's PP-100-F were obtained by placing a filter plug under a 19 mm diameter platen. The platen was brought into contact with the filter and an initial uncompressed diameter reading taken. In this condition an actual force of some 27 grams was exerted on the filter. The platen was then loaded with an additional 100 grams of weight. After about 10 seconds under this loading, a second reading was taken. The firmness was reported as a percentage and was calculated by multiplying the ratio of the second reading to the first reading by 100. In general, the range of filter firmnesses will be from about 94 percent to about 99 percent with a preferred range of from about 96 percent to about 98 percent.

The overall pressure drop of articles employing the improved mouthend piece in accordance with the present invention is preferably similar to or less than that of conventional cigarettes. The pressure drop of the mouthend piece itself will vary in accordance with the pressure drop of the front end piece of the smoking article. For preferred smoking articles, such as those described in Example I, infra. the pressure drop will generally be less than that of conventional mouthend pieces, normally in the range of about 0.1 to 6.0 cm 0 water/cm filter length, preferably in the range of from about 0.5 to about 4.5 cm water/cm filter length, and most preferably in the range of from about 0.7 to about 1.5 cm water/cm filter length. Filter pressure drop is the pressure drop in centimeters of water when 1050 $cm^3$/min. of air is passed through a filter plug. These pressure drops may be normalized to unit length of filter plug by dividing by the actual filter length.

Filter efficiency per unit length of the segment of non-woven thermoplastic fibers prepared in accordance with the present invention will in general be substantially less than that of a conventional cellulose acetate filter. Preferably, the filter efficiency of such materials will be less than that of low efficiency cellulose acetate tow filters made from an 8.0/40K material obtained from Celanese Corporation. As noted above, the mouthend piece of the present invention helps to reduce the temperature of the aerosol perceived by the user by, for example, distributing the aerosol generated during smoking over a larger surface area. Use of low efficiency materials in accordance with the present invention, however, also permits longer segments of the non-woven thermoplastic fibers to be used without interfering with desired aerosol delivery. This increases the residence time of the aerosol in the mouthend piece which also helps to reduce the temperature of the aerosol as perceived by the user.

The length of the segment of non-woven thermoplastic fibers used in the mouthend piece may vary broadly depending on a number of factors including the desired reduction in temperature of the aerosol as perceived by the user. For preferred smoking articles employing the mouthend piece of the present invention, the thermoplastic segment will generally be between about 10 mm and 40 mm in length, and preferably between about 15 mm and 35 mm in length, and most preferably about 30 mm in length.

The spacer member preferably used in practicing the present invention may be prepared from a number of materials including conventional cigarette filter materials, such as cellulose acetate tow, and materials such as tobacco, tobacco-containing paper, and a segment of conventional filter materials surrounding a tube.

The preferred material used to construct the spacer member is tobacco-containing paper. The preferred tobacco-containing paper comprises a web of reconstituted tobacco material obtained from Kimberly Clark Corporation as P144-185-GAPF Reconstituted Tobacco Sheet. The material includes about 60 percent tobacco principally in the form of flue-cured/burley tobacco stems and 35 percent soft wood pulp (based on dry weight of the material). The moisture content of the sheet-like material preferably is between about 11 and 14 percent. The material has a dry tensile strength of about 1,600 to about 3,300 gm/inch, and a dry basis weight of about 38 to about 44 g/sq. meter. The material is manufactured using a conventional papermaking-type process including the addition of about 2 percent glycerin or other humectant, about 1.8 percent potassium carbonate, about 0.1 percent flavorants and about 1 percent of a commercial sizing agent. The sizing agent is commercially available as Aquapel 360XC Reactive Size from Hercules Corp., Wilmington, Del.

The tobacco paper may be formed into a plug by conventional plug making techniques. However, for smoking articles employing the mouthend piece of the present invention, it preferably is formed by the double cone system used to form the segment of non-woven thermoplastic fibers.

The length of the spacer member will, in general, vary inversely with the length of the segment of non-woven thermoplastic fibers. For preferred smoking articles employing the mouthend piece in accordance with the present invention, it is generally between about 5 and 30 mm in length, preferably between about about 5 and 15 mm in length, and most preferably about 10 mm in length.

Preferred cigarette-type smoking articles which employ the improved mouthend piece in accordance with the present invention are described in the following patent applications:

Applicants Serial No. Filed Sensabaugh et al. 650,604 September 14, 1984 Shannon et al. 684,537 December 21, 1984 Farrier et al. 769,532 August 26, 1985 Banerjee et al. 939,203 December 8, 1986 Sensabaugh et al. EPO 85111467.8 September 11, 1985

(published 3/19/86) Banerjee et al. EPO 86109589.1 September 14, 1985

(published 3/4/87)

the disclosures of which are hereby incorporated by reference.

Figure 1:
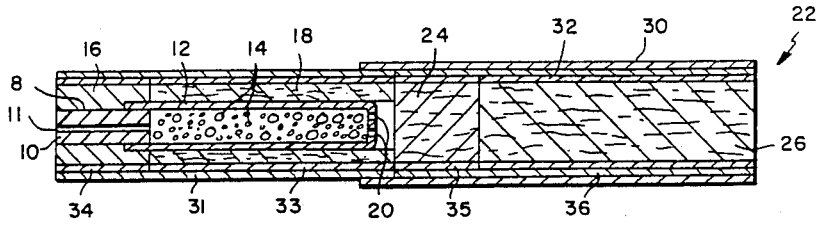
FIG. 1 is a longitudinal view of one preferred smoking article employing the improved filter material in accordance with the present invention.
Figure 1A:
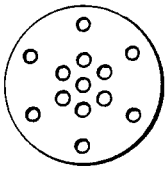
FIG. 1A illustrates, from the lighting end, a preferred fuel element passageway configuration.

One such preferred cigarette-type smoking article is set forth in FIG. 1 accompanying this specification. Referring to FIG. 1 there is illustrated a cigarette-type smoking article having a small carbonaceous fuel element 10 with a plurality of passageways 11 therethrough, preferably about thirteen arranged as shown in FIG. 1A. This fuel element is formed from an extruded mixture of carbon (preferably from carbonized paper), sodium carboxymethyl cellulose (SCMC) binder, $K_2CO_3$, and water, as described in the above referenced patent applications. The periphery 8 of fuel element 10 is encircled by a resilient jacket of insulating fibers 16, such as glass fibers. A metallic capsule 12 overlaps a portion of the mouthend of the fuel element 10 and encloses the physically separate aerosol generating means which contains a substrate material 14 which carries one or more aerosol forming materials. The substrate may be in particulate form, in the form of a rod, or in other forms as detailed in the above referenced patent applications. Capsule 12 is circumscribed by a jacket of tobacco 18. Two slit-like passageways 20 are provided at the mouth end of the capsule in the center of the crimped tube.

At the mouth end of tobacco jacket 18 is a mouthend piece 22, preferably comprising a cylindrical segment of a spacer member 24 and a segment of non-woven thermoplastic fibers 26 through which the aerosol passes to the user. The article, or portions thereof, is overwrapped with one or more layers of cigarette papers 30–36.

Upon lighting the aforesaid embodiment, the fuel element burns, generating the heat used to volatilize the tobacco flavor material and any additional aerosol forming substance or substances in the aerosol generating means. Because the preferred fuel element is relatively short, the hot, burning fire cone is always close to the aerosol generating means which maximizes heat transfer to the aerosol generating means, and resultant production of aerosol, especially when the preferred heat conducting member is used.

Because of the small size and burning characteristics of the fuel element, the fuel element usually begins to burn over substantially all of its exposed length within a few puffs. Thus, that portion of the fuel element adjacent to the aerosol generator becomes hot quickly, which significantly increases heat transfer to the aerosol generator, especially during the early and middle puffs. Because the preferred fuel element is so short, there is never a long section of nonburning fuel to act as a heat sink, as was common in previous thermal aerosol articles.

Because the aerosol forming substances are physically separate from the fuel element, they are exposed to substantially lower temperatures than are generated by the burning fuel, thereby minimizing the possibility of thermal degradation.

In preferred embodiments, the short carbonaceous fuel element, heat conducting member and insulating means cooperate with the aerosol generator to provide a system which is capable of producing substantial quantities of aerosol on virtually every puff. The close proximity of the fire cone to the aerosol generator after a few puffs, together with the insulating means, results in high heat delivery both during puffing and during the relatively long period of smolder between puffs.

In general, the combustible fuel elements which may be employed in preferred embodiments have a diameter no larger than that of a conventional cigarette (i.e., less than or equal to 8 mm), and are generally less than about 30 mm long. Advantageously the fuel element is about 15 mm or less in length, preferably about 10 mm or less in length. Advantageously, the diameter of the fuel element is between about 2 to 8 mm, preferably about 4 to 6 mm. The density of the fuel elements employed herein may generally range from about 0.7 g/cc to about 1.5 g/cc. Preferably the density is greater than about 0.85 g/cc.

The preferred material used for the formation of fuel elements is carbon. Preferably, the carbon content of these fuel elements is at least 60 to 70%, most preferably about 80% or more, by weight. High carbon content fuel elements are preferred because they produce minimal pyrolysis and incomplete combustion products, little or no visible sidestream smoke, and minimal ash, and have high heat capacity. However, lower carbon content fuel elements e.g., about 50 to 60% by weight may be used, especially where a minor amount of tobacco, tobacco extract, or a nonburning inert filler is used. Preferred fuel elements are described in greater detail in the above referenced patent applications.

The aerosol generating means used in practicing this invention is physically separate from the fuel element. By physically separate is meant that the substrate, container, or chamber which contains the aerosol forming materials is not mixed with, or a part of, the fuel element. This arrangement helps reduce or eliminate thermal degradation of the aerosol forming substance and the presence of sidestream smoke. While not a part of the fuel element, the aerosol generating means preferably abuts, is connected to, or is otherwise adjacent to the fuel element so that the fuel and the aerosol generating means are in a conductive heat exchange relationship. Preferably, the conductive heat exchange relationship is achieved by providing a heat conductive member, such as a metal foil, recessed from the lighting end of the fuel element, which efficiently conducts or transfers heat from the burning fuel element to the aerosol generating means.

The aerosol generating means is preferably spaced no more than 15 mm from the lighting end of the fuel element. The aerosol generating means may vary in length from about 2 mm to about 60 mm, preferably from about 5 mm to 40 mm, and most preferably from about 20 mm to 35 mm. The diameter of the aerosol generating means may vary from about 2 mm to about 8 mm, and is preferably from about 3 to 6 mm.

Preferably, the aerosol generating means includes one or more thermally stable materials which carry one or more aerosol forming substances. As used herein, a "thermally stable" material is one capable of withstanding the high, albeit controlled, temperatures, e.g., from about 400° C. to about 600° C., which may eventually exist near the fuel, without significant decomposition or burning. The use of such material is believed to help maintain the simple "smoke" chemistry of the aerosol, as evidenced by a lack of Ames test activity in the preferred embodiments. While not preferred, other aerosol generating means, such as heat rupturable microcapsules, or solid aerosol forming substances, are within the scope of this invention, provided they are capable of releasing sufficient aerosol forming vapors.

Thermally stable materials which may be used as the carrier or substrate for the aerosol forming substance are well known to those skilled in the art. Useful carriers should be porous, and must be capable of retaining an aerosol forming compound and releasing a potential aerosol forming vapor upon heating by the fuel. Useful thermally stable materials include adsorbent carbons, such as porous grade carbons, graphite, activated, or non-activated carbons, and the like, such as PC-25 and PG-60 available from Union Carbide Corp., as well as SGL carbon, available from Calgon, Corp. Other suitable materials include inorganic solids, such as ceramics, glass, alumina, vermiculite, clays such as bentonite, or mixtures thereof. Carbon and alumina substrates are preferred.

An especially useful alumina substrate is a high surface area alumina (about 280 $m^2/g$), such as the grade available from the Davison Chemical Division of W.R. Grace & Co. under the designation SMR-14-1896. This alumina (−14 to +20 U.S. mesh) is preferably sintered for about one hour at an elevated temperature, e.g., greater than 1000° C., preferably from about 1400° to 1550° C., followed by appropriate washing and drying, prior to use.

The aerosol forming substance or substances used in the articles of the present invention must be capable of forming an aerosol at the temperatures present in the aerosol generating means upon heating by the burning fuel element. Such substances preferably are non-tobacco, non-aqueous aerosol forming substances and are composed of carbon, hydrogen and oxygen, but they may include other materials. Such substances can be in solid, semi-solid, or liquid form. The boiling or sublimation point of the substance and/or the mixture of substances can range up to about 500° C. Substances having these characteristics include: polyhydric alcohols, such as glycerin, triethylene glycol, and propylene glycol, as well as aliphatic esters of mono-, di-, or polycarboxylic acids, such as methyl stearate, dimethyl dodecandioate, dimethyl tetradodecandioate, and others.

The preferred aerosol forming substances are polyhydric alcohols, or mixtures of polyhydric alcohols. More preferred aerosol formers are selected from glycerin, triethylene glycol and propylene glycol.

When a substrate material is employed as a carrier, the aerosol forming substance may be dispersed by any known technique on or within the substrate in a concentration sufficient to permeate or coat the material. For example, the aerosol forming substance may be applied full strength or in a dilute solution by dipping, spraying, vapor deposition, or similar techniques. Solid aerosol forming components may be admixed with the substrate material and distributed evenly throughout prior to formation of the final substrate.

While the loading of the aerosol forming substance will vary from carrier to carrier and from aerosol forming substance to aerosol forming substance, the amount of liquid aerosol forming substances may generally vary from about 20 mg to about 140 mg, and preferably from about 40 mg to about 110 mg. As much as possible of the aerosol former carried on the substrate should be delivered to the user as WTPM. Preferably, above about 2 weight percent, more preferably above about 15 weight percent, and most preferably above about 20 weight percent of the aerosol former carried on the substrate is delivered to the user as WTPM.

The aerosol generating means also may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials. Alternatively, these optional agents may be placed in the mouthend piece, or in the optional tobacco charge.

One particularly preferred aerosol generating means comprises the aforesaid alumina substrate containing spray dried tobacco extract, levulinic acid or glucose pentaacetate, one or more flavoring agents, and an aerosol former such as glycerin.

A charge of tobacco may be employed downstream from the fuel element. In such cases, hot vapors are swept through the tobacco to extract and distill the volatile components from the tobacco, without combustion or substantial pyrolysis. Thus, the user receives an aerosol which contains the tastes and flavors of natural tobacco without the numerous combustion products produced by a conventional cigarette.

Articles of the type disclosed herein may be used or may be modified for use as drug delivery articles, for delivery of volatile pharmacologically or physiologically active materials such as ephedrine, metaproterenol, terbutaline, or the like.

The heat conducting material employed as the container for the aerosol generating means is typically a metallic foil, such as aluminum foil, varying in thickness from less than about 0.01 mm to about 0.1 mm, or more. The thickness and/or the type of conducting material may be varied (e.g., Grafoil, from Union Carbide) to achieve the desired degree of heat transfer.

As shown in the embodiment illustrated in FIG. 1, the heat conducting member preferably contacts or overlaps the rear portion of the fuel element, and may form the container or capsule which encloses the aerosol producing substrate of the present invention. Preferably, the heat conducting member extends over no more than about one-half the length of the fuel element. More preferably, the heat conducting member overlaps or otherwise contacts no more than about the rear 5 mm, preferably 2–3 mm, of the fuel element. Preferred recessed members of this type do not interfere with the lighting or burning characteristics of the fuel element. Such members help to extinguish the fuel element when it has been consumed to the point of contact with the conducting member by acting as a heat sink. These members also do not protrude from the lighting end of the article even after the fuel element has been consumed.

The insulating members employed in the preferred smoking articles are preferably formed into a resilient jacket from one or more layers of an insulating material. Advantageously, this jacket is at least about 0.5 mm thick, preferably at least about 1 mm thick. Preferably, the jacket extends over more than about half, if not all of the length of the fuel element. More preferably, it also extends over substantially the entire outer periphery of the fuel element and the capsule for the aerosol generating means. As shown in the embodiment of FIG. 1, different materials may be used to insulate these two components of the article.

The currently preferred insulating materials, particularly for the fuel element, are ceramic fibers, such as glass fibers. Preferred glass fiber are experimental materials produced by Owens - Corning of Toledo, Ohio under the designations 6432 and 6437, which have softening points of about 650° C. Other suitable insulating materials, preferably non-combustible inorganic materials, may also be used.

To maximize aerosol delivery, which otherwise could be diluted by radial (i.e. outside) air infltration through the article, a non-porous paper may be used from the aerosol generating means to the mouth end.

Papers such as these are known in the cigarette and/or paper arts and mixtures of such papers may be employed for various functional effects. Preferred papers used in the articles of the present invention include RJR Archer's 8-0560-36 Tipping with Lip Release paper, Ecusta's 646 Plug Wrap and ECUSTA 30637-801-12001 manufactured by Ecusta of Pisgah Forest, NC, and Kimberly-Clark Corporation's papers p850-186-2, p1487-184-2 and p850-1487-125.

The aerosol produced by the preferred articles of the present invention is chemically simple, consisting essentially of air, oxides of carbon, aerosol former including any desired flavors or other desired volatile materials, water and trace amounts of other materials. The WTPM produced by the preferred articles of this invention has no mutagenic activity as measured by the Ames test, i.e., there is no significant dose response relationship between the WTPM produced by preferrred articles of the present invention and the number of revertants occurring in standard test microorganisms exposed to such products. According to the proponents of the Ames test, a significant dose dependent response indicates the presence of mutagenic materials in the products tested. See Ames *et al.*, *Mut. Res.*, 31: 347–364 (1975); Nagao *et al.*, *Mut. Res.*, 42: 335 (1977).

A further benefit from the preferred embodiments of the present invention is the relative lack of ash produced during use in comparison to ash from a conventional cigarette. As the preferred carbon fuel element is burned, it is essentially converted to oxides of carbon, with relatively little ash generation, and thus there is no need to dispose of ashes while using the article.

The use of the improved mouthend piece of the present invention in cigarette-like smoking articles will be further illustrated with reference to the following examples which will aid in the understanding of the present invention, but which are not to be construed as a limitation thereof. All percentages reported herein, unless otherwise specified, are percent by weight. All temperatures are expressed in degrees Celsius and are uncorrected.

EXAMPLE I

A smoking article of the type illustrated in FIG. 1 was made in the following manner.

A. Fuel Source Preparation

The fuel element (10 mm long, 4.5 mm o.d.) having an apparent (bulk) density of about 0.86 g/cc, was prepared from carbon (90 wt. percent), SCMC binder (10 wt. percent) and $K_2CO_3$ (1 wt. percent).

The carbon was prepared by carbonizing a non-talc containing grade of Grand Prairie Canadian Kraft hardwood paper under a nitrogen blanket, at a step-wise increasing temperature rate of about 10° C. per hour to a final carbonizing temperature of 750° C.

After cooling under nitrogen to less than about 35° C., the carbon was ground to a mesh size of minus 200. The powdered carbon was then heated to a temperature of up to about 850° C. to remove volatiles.

After again cooling under nitrogen to less than about 35° C., the carbon was ground to a fine powder, i.e., a powder having an average particle size of from about 0.1 to 50 microns.

This fine powder was admixed with Hercules 7HF SCMC binder (9 parts carbon : 1 part binder), 1 wt. percent $K_2CO_3$, and sufficient water to make a stiff, dough-like paste.

Fuel elements were extruded from this paste having seven central holes each about 0.021 in. in diameter and six peripheral holes each about 0.01 in. in diameter. The web thickness or spacing between the central holes was about 0.008 in. and the average outer web thickness (the spacing between the periphery and peripheral holes) was 0.019 in. as shown in FIG. 1A.

These fuel elements were then baked-out under a nitrogen atmosphere at 900° C. for three hours after formation.

B. Spray Dried Extract

A blend of flue cured tobaccos were ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, such as an Anhydro Size No. 1, at an inlet temperature of from about 215 ° -230 ° C. and collecting the dried powder material at the outlet of the drier. The outlet temperature varied from about 82° -90° C.

C. Preparation

High surface area alumina (surface area of about 280 $m^2/g$) from W.R. Grace & Co., having a mesh size of from −14 to +20 (U.S. was sintered at a soak temperature of about 1400° C. to 1550° C. for about one hour, washed with water and dried. This sintered alumina was combined, in a two step process, with the ingredients shown in Table I in the indicated proportions:

TABLE I

| | |
|---|---|
| Alumina | 68.0% |
| Glycerin | 19.0% |
| Spray Dried Extract | 7.0% |
| Flavor Package | 6.0% |
| Total: | 100.0% |

The flavor package is a mixture of flavor compounds which simulates the taste of cigarette smoke. One such material which has been used herein was obtained from Firmenich of Geneva, Switzerland under the designation T69-22.

In the first step, the spray dried tobacco extract was mixed with sufficient water to form a slurry. This slurry was then applied to the alumina carrier described above by mixing until the slurry was uniformly absorbed by the alumina. The treated alumina was then dried to reduce the moisture content to about 1 wt. percent. In the second step, this treated alumina was mixed with a combination of the other listed ingredients until the liquid was substantially absorbed within the alumina carrier.

D. Assembly

The capsule used to construct the FIG. 1 smoking article was prepared from deep drawn aluminum. The capsule had an average wall thickness of about 0.004 in. (0.1 mm), and was about 30 mm in length, having an outer diameter of about 4.5 mm. The rear of the container was sealed with the exception of two slot-like openings (each about 0.65×3.45 mm, spaced about 1.14 mm apart) to allow passage of the aerosol former to the user. About 325 mg of the aerosol producing substrate described above was used to load the capsule. A fuel element prepared as above, was inserted into the open end of the filled capsule to a depth of about 3 mm.

E. Insulating Jacket

The fuel element capsule combination was overwrapped at the fuel element end with a 10 mm long, glass fiber jacket of Owens-Corning 6437 (having a softening point of about 650° C.), with 3 wt. percent pectin binder, to a diameter of about 7.5 mm. The glass fiber jacket was then wrapped with an innerwrap material, a Kimberly Clark experimental paper designated P780-63-5.

F. Tobacco Jacket

A 7.5 mm diameter tobacco rod (28 mm long) with an overwrap of Kimberly Clark's P1487-125 paper was modified by insertion of a probe to have a longitudinal passageway of about 4.5 mm diameter therein.

G. Assembly

The jacketed fuel element—capsule combination was inserted into the tobacco rod passageway until the glass fiber jacket abutted the tobacco. The glass fiber and tobacco sections were joined together by an outerwrap material which circumscribed both the fuel element/insulating jacket/innerwrap combination and the wrapped tobacco rod. The outerwrap was a Kimberly Clark paper designated P1768-65-2.

A mouthend piece of the type illustrated in FIG. 1, was constructed by combining two sections; (1) a 10 mm long, 7.5 mm diameter spacer member adjacent the capsule, prepared from a tobacco sheet material obtained from Kimberly-Clark Corporation designated P144-185-GAPF, overwrapped with Kimberly Clark's P850-186-2 paper and (2) a 30 mm long, 7.5 mm diameter cylindrical segment of a non-woven meltblown thermoplastic polypropylene web obtained from Kimberly-Clark Corporation designated PP-100-F overwrapped with Kimberly-Clark Corporation's P1487-184-2 paper. Both sections of the mouthend piece were prepared by passing the tobacco paper and web of thermoplastic fibers through the double cone system described above. These two sections were combined with a combining overwrap of Kimberly-Clark Corporation's P850-186-2 paper.

The combined mouthend piece section was joined to the jacketed fuel element—capsule section by a final overwrap of Ecusta's 30637-801-12001 tipping paper.

Smoking articles thus prepared produced an aerosol resembling tobacco smoke without any undesirable off-taste due to scorching or thermal decomposition of the aerosol forming material. Articles thus prepared were smoked under so-called human conditions which consist of 50 ml puff volumes of 2 second duration, separated by 28 seconds of smolder, for at least about six puffs. As can be seen from FIG. 6 the lip thermal temperature as measured by a Cyclops portable Radiation Thermometer at about 4 mm in from the end of the mouthend piece was less than or equal to body temperature. In other words, such articles produced aerosol without the undesirable "hotness" perceived by users of similar articles not employing the improved mouthend piece.

EXAMPLE II

Smoking articles similar to those described in Example I were constructed with mouthend pieces illustrated in FIG. 2 and FIGS. 2A–2D in the following manner. The article illustrated in FIG. 2 served as a control article for the articles of FIGS. 2A–2D which have mouthend pieces in accordance with the present invention.

A. Fuel Element Preoaration

Grand Prairie Canadian (GPC) Kraft paper (non-talc grade) made from hardwood and obtained from Buckeye Cellulose Corp., Memphis, TN, was shredded and placed inside a 9" diameter, 9" deep stainless steel furnace. The furnace chamber was flushed with nitrogen, and the furnace temperature was raised to 200° C. and held for 2 hours. The temperature in the furnace was then increased at a rate of 5° C. per hour to 350° C. and was held at 350 ° C. for 2 hours. The temperature of the furnace was then increased at 5° C. per hour to 750° C. to further pyrolize the cellulose. Again the furnace was held at temperature for 2 hours to assure uniform heating of the carbon. The furnace was then cooled to room temperature and the carbon was ground into a fine powder (less than 400 mesh) using a "Trost" mill. This powdered carbon (CGPC) had a tapped density of 0.6 g/cc and hydrogen plus oxygen level of 4%.

Nine parts of this carbon powder were mixed with one part of SCMC powder, $K_2CO_3$ was added at wt. percent, and water was added to make a thin slurry, which was then cast into a sheet and dried. The dried sheet was then reground into a fine powder and sufficient water was added to make a plastic mix which was stiff enough to hold its shape after extrusion, e.g., a ball of the mix will show only a slight tendency to flow in a one day period. This plastic mix was then loaded into a room temperature batch extruder. The female extrusion die for shaping the extrudate had tapered surfaces to facilitate smooth flow of the plastic mass. A low pressure (less than 5 tons per square inch or $7.03\times10^6$ kg per square meter) was applied to the plastic mass to force it through a female die of 4.6 mm diameter. The wet rod was then allowed to dry at room temperature overnight. To assure that it was completely dry it was then placed into an oven at 80° C. for two hours. This dried rod had a density of 0.85 g/cc, a diameter of 4.5 mm, and an out of roundness of approximately 3%.

The dry, extruded rod was cut into 10 mm lengths and seven holes were drilled through the length of the rod.

Other fuel elements have been made in the forgoing manner without regrinding or drying the carbon powder slurry mixture. In such articles fuel elements are directly extruded from a stiff, dough-like paste prepared from the carbon powder mixture.

B. Spray Dried Extract

Tobacco (Burley, Flue Cured, Turkish, etc. was ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, such as an Anhydro Size No. 1, at an inlet temperature of from about 215° –230° C. and collecting the dried powder material at the outlet of the drier. The outlet temperature varied from about 82° –90° C.

C. Substrate Preoaration

High surface area alumina (surface area $=280\ m^2/g$) from W.R. Grace & Co. having a mesh size of from $-14$ to $+20$ (U.S.) was sintered at a soak temperature of about 1400° C. for about one hour and cooled. The alumina was washed with water and dried. The sintered alumina (640 mg) was further treated with an aqueous solution containing 107 mg of spray dried flue cured tobacco extract and dried to a moisture content of about 1 weight percent. This material was then treated with a mixture of 33 mg of glycerin and 17 mg of a flavor component obtained from Firmenich, Geneva, Switzerland, under the designation T69-22.

D. Assembly

The metallic containers for the substrate were 30 mm long spirally wound aluminum tubes obtained from Niemand, Inc., having a diameter of about 4.5 mm. Alternatively, a deep drawn capsule prepared from aluminum tubing about 4 mil thick (0.1016 mm), about 32 mm in length, having an outer diameter of about 4.5 mm may be used. One end of each of these tubes was crimped to seal the mouthend of the capsule. The sealed end of the capsule was provided with two slot-like openings (each about $0.65\times3.45$ mm, spaced about 1.14 mm apart) to allow passage of the aerosol former to the user. Approximately 170 mg of the modified alumina was used to fill each of the containers. After the metallic containers were filled, each was joined to a fuel element by inserting about 2 mm of the fuel element into the open end of the container.

E. Insulating Jacket

The fuel element—capsule combination was overwrapped at the fuel element end with a 10 mm long, glass fiber jacket of Owens-Corning 6437 (having a softening point of about 650° C.), with 4 wt. percent pectin binder, to a diameter of about 7.5 mm and overwrapped with P878-63-5 paper.

F. Tobacco Jacket

A 7.5 mm diameter tobacco rod (28 mm long) with a 646 plug wrap overwrap (e.g., from a non-filter cigarette) was modified with a probe to have a longitudinal passageway (about 4.5 mm diameter) therein.

G. Assembly

The jacketed fuel element—capsule combination was inserted into the tobacco rod passageway until the glass fiber jacket abutted the tobacco. The glass fiber and tobacco sections were overwrapped with Kimberly-Clark Corporation P878-16-2.

Figure 2:
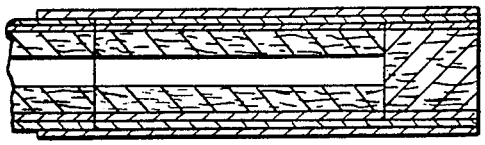
FIG. 2 illustrates a mouthend piece of a control smoking article.
Figure 2A:
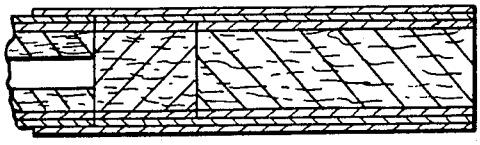
FIGS. 2A–2D illustrate various mouthend pieces constructed in accordance with the present invention.
Figure 2B:
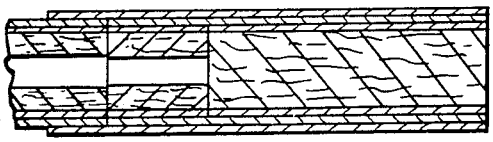

As shown in FIG. 2, a hollow cellulose acetate tube (30 mm long) overwrapped with 646 plug wrap, was joined to a low efficiency 8.0/40K filter element from Celanese Corp. (10 mm long) also overwrapped with 646 plug wrap by, RJR Archer Inc. 8-0560-36 tipping with lip release paper.

The combined mouthend piece section was joined to the jacketed fuel element—capsule section by a small section of white paper and glue.

Figure 2C:
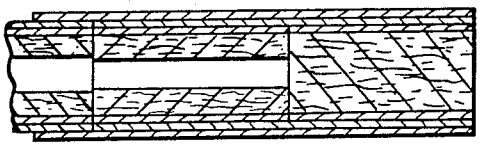
Figure 2D:
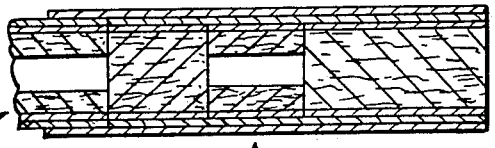

Smoking articles having the mouthend piece configurations in accordance with the present invention are illustrated in FIGS. 2A–2D. These articles were assembled in a manner similar to the so-called control smoking article of FIG. 2. The mouthend piece in FIG. 2A has a 10 mm section of puffed tobacco and a 30 mm section of a non-woven web of meltblown polypropylene fibers similar to the above described Kimberly-Clark Corporation PP-100-F material. The mouthend piece of FIG. 2B has a 10 mm section of a cellulose acetate tube along with a 30 mm section of the above polypropylene material. FIG. 2C is similar to FIG. 2B except that both sections are 20 mm in length. FIG. 2D has a 10 mm section of puffed tobacco, a 10 mm section of a cellulose acetate tube and a 20 mm section of the polypropylene material.

Figure 3:
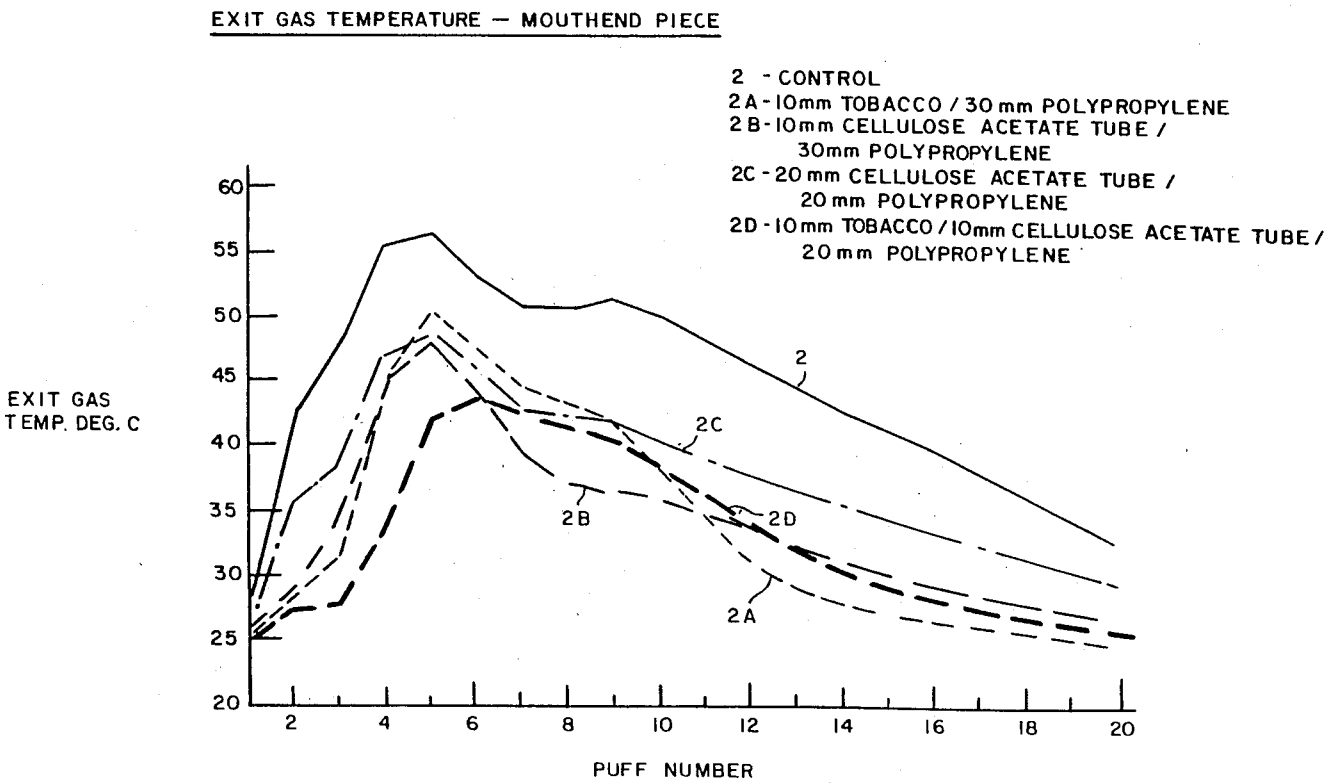
FIG. 3 illustrates the exit gas temperatures of smoking articles employing the mouthend pieces of FIG. 2.

These articles were smoked under human conditions which consist of 50 ml puff volumes of 2 second duration, separated by 28 seconds of smolder. The exit gas temperatures of such articles are illustrated in FIG. 3. These temperatures were measured by placing a thermocouple about 1 mm from the end of the mouthend piece. As can be seen from FIG. 3, the exit gas temperatures of smoking articles employing mouthend pieces in accordance with the present invention were substantially reduced as compared with the control smoking article. This reduction in exit gas temperature corresponds with the reduction in "hotness" of aerosol perceived by the user.

What is claimed is:

1. A cigarette-type smoking article comprising:
(a) a fuel element;
(b) a physically separate aerosol generating means longitudinally disposed behind the fuel element including at least one aerosol forming material; and
(c) means for delivering the aerosol produced by the aerosol generating means to the user, the delivery means including a segment formed from non-woven thermoplastic fibers.

2. The smoking article of claim 1, further comprising a spacer member longitudinally disposed between the aerosol generating means and the non-woven segment.

3. The smoking article of claim 1 or 2, wherein the segment of thermoplastic fibers is formed from materials selected from the group consisting of polyolefins and polyesters.

4. The smoking article of claim 3, wherein the segment of thermoplastic fibers comprises polypropylene.

5. The smoking article of claim 3, wherein the segment of thermoplastic fibers comprises meltblown fibers.

6. The smoking article of claim 1 or 2, wherein the segment of thermoplastic fibers is between about 10 mm and 40 mm in length.

7. The smoking article of claim 6, wherein the segment of thermoplastic fibers is between about 15 mm and 35 mm in length.

8. The smoking article of claim 6, wherein the segment of thermoplastic fibers is about 30 mm in length.

9. The smoking article of claim 2, wherein the spacer member is a mass of material selected from the group of tobacco, tobacco containing paper, cellulose acetate and cellulose acetate surrounding a tube.

10. The smoking article of claim 2, wherein the spacer member is between about 5 mm and 30 mm in length.

11. The smoking article of claim 10, wherein the spacer member is between about 5 mm and 15 mm in length.

12. The smoking article of claim 10, wherein the spacer member is about 10 mm in length.

13. The smoking article of claim 1, 2, 9, 10, 11 or 12, wherein the segment of thermoplastic fibers is formed by gathering or folding a non-woven web of the fibers into a cylindrical shape.

14. The smoking article of claim 9, wherein the spacer member is formed by gathering or folding the mass of material into a cylindrical shape.

15. The smoking article of claim 1 or 2, wherein the fuel element and the aerosol generating means are in a conductive heat exchange relationship.

16. The smoking article of claim 15, wherein the conductive heat exchange relationship is provided by a heat conductive member which contacts both the fuel element and the aerosol generating means.

17. The smoking article of claim 16, wherein the heat conductive member circumscribes at least a portion of the fuel element.

18. The smoking article of claim 16, wherein the heat conductive member encloses at least a portion of the aerosol forming material.

19. The smoking article of claim 1 or 2, wherein the fuel element comprises carbon.

20. The smoking article of claim 19, wherein the fuel element is less than 30 mm long and has a density of at least about 0.5 g/cc.

21. The smoking article of claim 1 or 2, further comprising an insulating member which encircles at least a portion of the fuel element.

22. The smoking article of claim 21, wherein the insulating member is a resilient, non-burning member at least 0.5 mm thick.

23. The smoking article of claim 1 or 2, further comprising a resilient insulating member encircling at least a portion of the aerosol generating means.

24. The smoking article of claim 23, wherein the insulating member comprises a tobacco containing material.

25. A cigarette-type smoking article comprising:
(a) a carbonaceous fuel element;
(b) a physically separate aerosol generating means including at least one aerosol forming material; and
(c) a mouthend piece for delivering the aerosol produced by the aerosol generating means to the user comprising a 10 to 40 mm long segment formed from a nonwoven web of meltblown thermoplastic fibers and a 5 to 30 mm long spacer member longitudinally disposed between the aerosol generating means and the nonwoven web segment.

26. A mouthend piece for a smoking article having a fuel element and a physically separate aerosol generating means, the mouthend piece comprising a segment formed from a non-woven web of thermoplastic fibers and a spacer member segment, wherein the non-woven web segment is located at the mouth end of the mouth end piece or between the mouth end and the spacer member.

27. The mouthend piece of claim 26, wherein the segment of thermoplastic fibers are formed from materials selected from the group consisting of polyolefins and polyesters.

28. The mouthend piece of claim 27, wherein the segment of thermoplastic fibers comprises polypropylene.

29. The mouthend piece of claim 27, wherein the segment of thermoplastic fibers comprises meltblown fibers.

30. The mouthend piece of claim 26, wherein the segment contains one or more additives.

31. The mouthend piece of claim 26, wherein the segment of thermoplastic fibers is between about 10 mm and 40 mm in length.

32. The mouthend piece of claim 31, wherein the segment of thermoplastic fibers is between about 15 mm and 35 mm in length.

33. The mouthend piece of claim 32, wherein the segment of thermoplastic fibers is about 30 mm in length.

34. The mouthend piece of claim 26, wherein the spacer member is a mass of material selected from the group of tobacco, tobacco containing paper, cellulose acetate and cellulose acetate surrounding a tube.

35. The mouthend piece of claim 26, wherein the spacer member is between about 5 mm and 30 mm in length.

36. The mouthend piece of claim 35, wherein the spacer member is between about 5 mm and 15 mm in length.

37. The mouthend piece of claim 35, wherein the spacer member is about 10 mm in length.

38. The mouthend piece of claim 26, 27, 28, 29, 30, 31, 32, 33, 34, 35, 36 or 37, wherein the segment of thermoplastic fibers is formed by gathering or folding the thermoplastic material into a cylindrical shape.

39. The mouthend piece of claim 38, wherein the spacer member is formed by gathering or folding the mass of material into a cylindrical shape.

40. The smoking article of claim 25, wherein the meltblown thermoplastic fibers comprise polypropylene and the spacer member is a mass of material selected from the group of a tobacco-containing paper, tobacco, and cellulose acetate.

41. The smoking article of claim 40, wherein the nonwoven web segment is formed by gathering or folding the nonwoven web into the shape of a cylinder.

42. The smoking article of claim 41, wherein the spacer member is formed by gathering or folding a tobacco-containing paper into a cylindrical shape.

43. The smoking article of claim 40, 41, or 42, wherein the spacer member is in the form of a plug.

44. A cigarette-type smoking article comprising:
(a) a fuel element;
(b) a physically separate aerosol generating means including at least one aerosol forming material; and
(c) a mouthend piece for delivering the aerosol produced by the aerosol generating means to the user comprising a 10 to 40 mm long segment formed from a nonwoven web of thermoplastic fibers and a 5 to 30 mm long segment formed from a tobacco-containing paper longitudinally disposed between the aerosol generating means and the nonwoven web segment.

45. The smoking article of claim 44, wherein the nonwoven web comprises meltblown polypropylene.

46. The smoking article of claim 45, wherein the nonwoven web segment is formed by gathering or folding the nonwoven web into the shape of a cylinder.

47. The smoking article of claim 44, 45, or 46, wherein the tobacco-containing paper segment is formed by gathering or folding the paper into a cylindrical shape.

48. The smoking article of claim 47, wherein the tobacco-containing paper segment is between about 5 and 15 mm in length.

49. The smoking article of claim 44, 45, or 46, wherein the tobacco-containing paper segment is in the form of a plug.

50. A cigarette-type smoking article comprising:
(a) a fuel element;
(b) a physically separate aerosol generating means including at least one aerosol forming material; and
(c) means for delivering the aerosol produced by the aerosol generating means to the user, the delivery means including a segment formed from nonwoven thermoplastic fibers and a spacer member in the form of a mass of material longitudinally disposed between the aerosol generating means and the non-woven segment.

51. The smoking articles of claim 1, 25, 44, or 50, wherein the exit gas temperature of the smoking articles is less than about 50° C.

* * * * *

UNITED STATES PATENT AND TRADEMARK OFFICE

CERTIFICATE OF CORRECTION

PATENT NO. : 4,903,714

DATED : February 27, 1990

INVENTOR(S) : Russell D. Barnes et al.

It is certified that error appears in the above—identified patent and that said Letters Patent is hereby corrected as shown below:

Title Page:

References omitted under U.S. Patent Documents [56]:
3,119,396 Tanquary
3,353,543 Sproull et al.

Col. 1, line 26, "4,84,089" should be --4,284,089--.
Col. 3, line 65, "(cm2)" should be --($cm^2$)--.
Col. 5, line 44, "bonate" should be --carbonate--.
Col. 6, line 45, after "about" insert --1--.
Col. 7, line 15, delete "0" after --cm--.

Col. 12, line 48, "p1487-184-2 and p850-1487-125" should be --P1487-184-2 and P850-1487-125--.
Col. 15, line 46, "Preoaration" should be --Preparation--.
Col. 15, line 65, after "at" insert --1--.
Col. 16, line 41, "Preoaration" should be --Preparation--.
Col. 16, line 51, "33" should be --233--.

UNITED STATES PATENT AND TRADEMARK OFFICE

CERTIFICATE OF CORRECTION

PATENT NO. : 4,903,714

DATED : February 27, 1990

INVENTOR(S) : Russell D. Barnes et al.

It is certified that error appears in the above-identified patent and that said Letters Patent is hereby corrected as shown below:

Col. 18, line 3, after "means" insert --being separate from the aerosol generating means and--.

Signed and Sealed this

Ninth Day of April, 1991

*Attest:*

*Attesting Officer*

HARRY F. MANBECK, JR.

*Commissioner of Patents and Trademarks*